US005324882A

United States Patent [19]

Ohta et al.

[11] Patent Number: 5,324,882

[45] Date of Patent: Jun. 28, 1994

[54] TONE GENERATING APPARATUS PRODUCING SMOOTHLY LINKED WAVEFORMS

[75] Inventors: Fumiaki Ohta; Yasushi Sato, both of Hamamatsu, Japan

[73] Assignee: Kabushiki Kaisha Kawai Gakki Seisakusho, Hamamatsu, Japan

[21] Appl. No.: 80,260

[22] Filed: Jun. 21, 1993

[30] Foreign Application Priority Data

Aug. 24, 1992 [JP] Japan ..... 4-246012

[51] Int. Cl.[5] ..... G10H 1/057; G10H 7/00

[52] U.S. Cl. ..... 84/604; 84/627; 84/DIG. 9

[58] Field of Search ..... 84/604, 603, 627, 622-655, 84/DIG. 9

[56] References Cited

U.S. PATENT DOCUMENTS

| | | | |
|---|---|---|---|
| 5,086,475 | 1/1992 | Kutaragi et al. | 84/603 |
| 5,185,491 | 2/1993 | Izumisawa et al. | 84/627 |
| 5,194,681 | 3/1993 | Kudo | 84/603 |
| 5,196,639 | 3/1993 | Lee et al. | 84/603 |

*Primary Examiner*—Stanley J. Witkowski
*Attorney, Agent, or Firm*—Joseph C. Mason, Jr.; Ronald E. Smith; Kaoru Kawanami

[57] ABSTRACT

A tone generating apparatus that employs a read-out system comprises a waveform memory wherein are stored, as waveform data for a transient portion, waveform data that have a weighted attenuation characteristic and that are stored at a predetermined interval within a stationary portion following a rising portion of the musical tone, and waveform data that are obtained by extracting and linking multiple sets of the waveform data at the predetermined interval within a stationary portion, by filtering the resultant waveform data by employing a filtering process that does not alter phase information, by extracting from filtered waveform data waveform data for an interval equivalent to the predetermined interval, by linking together the extracted waveform data in numbers equivalent to the number of waveforms included in the predetermined interval, and by weighting the resultant waveform data with a rising characteristic; and wherein are further stored, as waveform data for a repetitive portion, the filtered waveform data.

7 Claims, 7 Drawing Sheets

TONE GENERATING APPARATUS PRODUCING SMOOTHLY LINKED WAVEFORMS

BACKGROUND OF THE INVENTION

1. Field of the Invention

The present invention relates to a tone generating apparatus, for the production of tone signals, that is intended for use in such electronic musical instruments as electronic keyboards, electronic pianos, and synthesizers.

Currently, various electronic musical instruments have been developed and are in practical use. Each such electronic musical instrument incorporates a tone generating apparatus and generates musical tones with a variety of timbres that correspond to a player's selection.

A desirable characteristic for an electronic musical instrument is that it produce clear musical tones with as little extraneous noise as possible.

2. Description of the Related Art

Well known in the conventional art is a tone generating apparatus that employs, for the production of musical tones, a read-out system that sequentially acquires tone waveform data, which has previously been stored in a memory, and uses the acquired data to reproduce tone signals.

For a musical tone, a tone generating apparatus that employs such a read-out system stores in a memory, as tone waveform data, a rising portion of a musical tone and a succeeding repetitive portion. To produce a sustained tone signal, such a tone generating apparatus reads the tone waveform data that correspond to the rising portion and the repetitive portion once, and then iteratively reads the tone waveform data for the repetitive portion.

When tone waveform data for the repetitive portion is iteratively read with this system, however, it is difficult to exactly read a predetermined cycle. Also, while data for the repetitive portion are being iteratively read, discontinuities occur at the junctures of the repeated cycles. As these discontinuities interrupt the smooth flow of musical tones and interject unnecessary harmonic overtones, the quality of the musical tones that are produced is degraded.

As shown in FIG. 8, for example, when one cycle of a sinusoidal waveform is employed as a repetitive portion, during iterative data reading improper extraction of a tone signal causes a discontinuity N.

When a sinusoidal waveform that has no discontinuities, as shown in FIG. 5, is employed, its spectrum is as depicted in FIG. 6 and a clear musical tone, which includes only a frequency component of the associated tone signal, is obtained.

However, as shown by the spectrum in FIG. 9, a waveform with discontinuities N, such as is depicted in FIG. 8, has multiple unwanted harmonic overtones that are not included in the original waveform.

SUMMARY OF THE INVENTION

As described above, it is difficult for a tone generating apparatus in a conventional read-out system to sequentially read tone waveform data for a repetitive portion at exactly predetermined cycles. Also, discontinuities occur at the junctures of the repeated cycles that produce unnatural sustained musical tones and multiple unwanted harmonic overtones, and thus greatly degrade musical tone quality. To overcome these shortcomings, it is an object of the present invention to provide a tone generating apparatus that does not produce discontinuities while reading tone waveform data for a repetitive portion, that ensures the smooth linking of musical tones, that can prevent the production of unwanted harmonic overtones, and that produces musical tones of high quality.

To achieve the object, a tone generating apparatus according to the present invention, which sequentially performs one-time reading of waveform data for a rising portion, a transient portion and a repetitive portion of a musical tone, and performs iterative reading of waveform data for the repetitive portion to produce musical tones, comprises:

a waveform memory, for storing tone waveform data that consist of waveform data for the rising portion of a musical tone, the transient portion following the rising portion and the repetitive portion following the transient portion, wherein are stored, as the waveform data for the transient portion, waveform data that have a weighted attenuation characteristic and that are stored at a predetermined interval within a stationary portion following the rising portion of the musical tone, and waveform data that are obtained by extracting and linking multiple sets of the waveform data at the predetermined interval within the stationary portion, by filtering the resultant waveform data by employing a filtering process that does not alter phase information, by extracting from filtered waveform data waveform data for an interval equivalent to the predetermined interval, by linking together the extracted waveform data in numbers equivalent to the number of waveforms included in the predetermined interval, and by weighting the resultant waveform data with a rising characteristic; and wherein are further stored, as the waveform data for the repetitive portion, the filtered waveform data.

According to the present invention, to store tone waveform data in a waveform memory, a fade-out process is performed on a predetermined interval following a rising portion of a musical tone. Then, mixing (cross-fade mixing) is performed on the resultant data and waveform data, which is obtained by performing a fade-in process on the waveform data in a predetermined cycle, that has been prepared through the filter process based on a waveform in an arbitrary interval of a stationary portion of the original musical tone. Filtered waveform data are therefore stored for a repetitive reading portion following the predetermined interval.

Transition from a rising portion of a musical tone to a repetitive reading portion becomes smoother, and discontinuities disappear because the iteratively read waveform data has been filtered. Produced musical tones, therefore, sound natural, unwanted harmonic overtones are eliminated, and the quality of the produced musical tones is enhanced.

DETAILED DESCRIPTION OF THE PREFERRED EMBODIMENT

Figure 1:
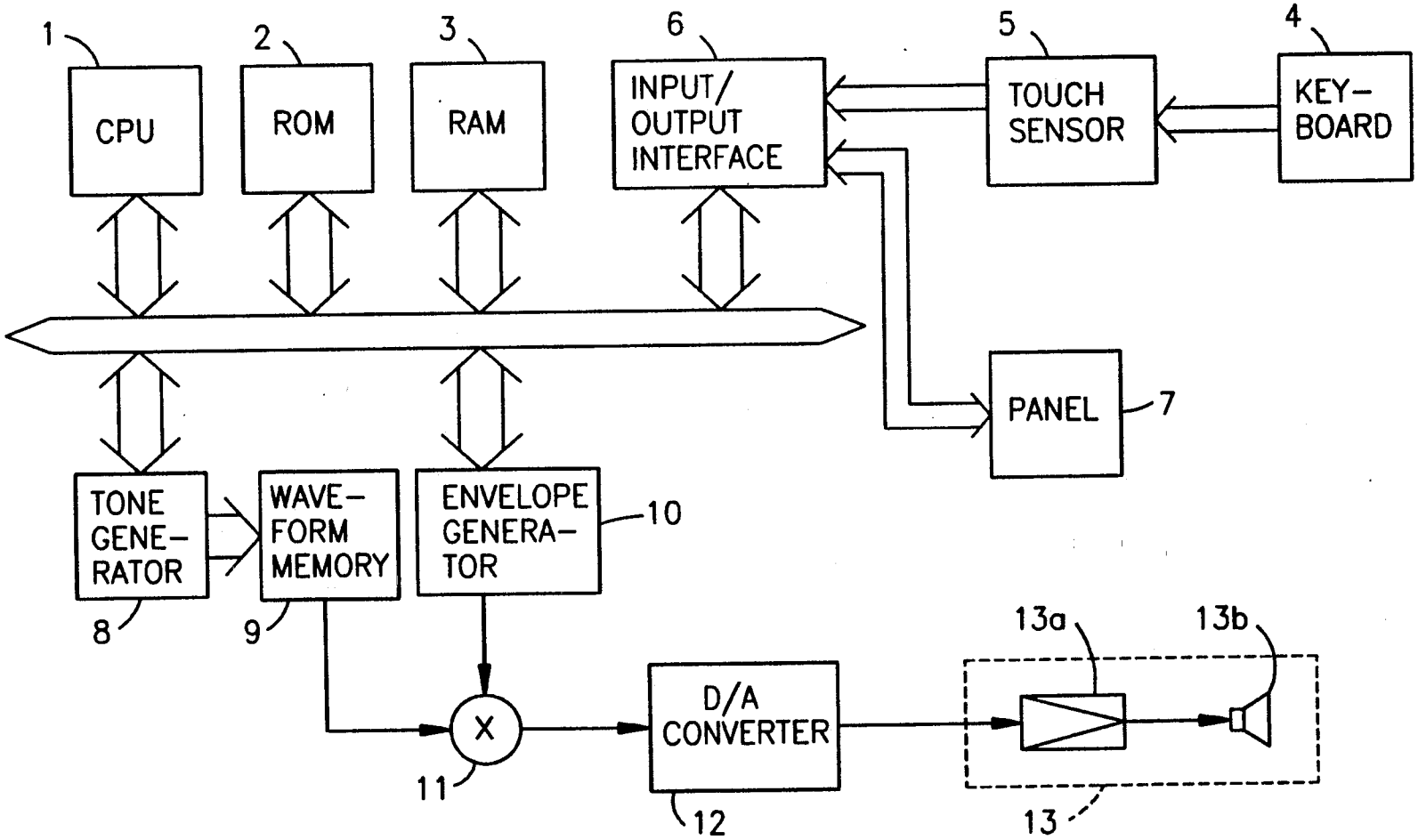
FIG. 1 is a block diagram illustrating the arrangement of one embodiment of an electronic musical instrument wherein a tone generating apparatus of the present invention is employed.

FIG. 1 is a block diagram showing an arrangement for an electronic musical instrument that incorporates a tone generating apparatus according to the present invention.

A central processing unit (hereafter referred to as a "CPU") 1 controls the individual sections of the electronic musical instrument by sequentially reading, via a system bus 14, and executing a control program, which is stored in a program memory section in a read only memory (hereafter referred to as a "ROM") 2.

Besides the control program for activating the CPU 1, timbre data and other various fixed datum constants are stored in the ROM 2.

A random access memory (hereafter referred to as a "RAM") 3 is used to transmit and store given data stored in the ROM 2, and includes various registers and a work area for control of the electronic musical instrument.

A keyboard 4, a group of keyboard switches, signals the depression or release of a key by a player. Switch ON/OFF information from the keyboard 4 is sent to a touch sensor 5.

In response to the switch ON/OFF information from the keyboard 4, the touch sensor 5 uses a well known touch detector to detect key codes that indicate whether a key has been depressed or released and touch data that indicate key depression force, and transmits such data to an input/output interface 6.

A panel 7 consists of a mode select Switch, a timbre select switch, a rhythm select switch, and a number of special effects switches, and gives various instructions to the electronic musical instrument. The states of the switches on the panel 7 are detected by a panel scan circuit (not shown) and sent as panel switch codes to the input/output interface 6.

The input/output interface 6 transmits the key code of a depressed or released key, the touch data, and the panel switch code from the panel 7 to the CPU 1 via a system bus 14.

A tone generator 8 controls generation of a tone signal. More specifically, the tone generator generates a tone signal by sequentially reading, from a waveform memory 9, tone waveform data that correspond to a timbre selected on the panel 7 and the key code of a depressed or released key on the keyboard 4. The details of the tone generator 8 will be explained later.

Multiple sets of tone waveform data that correspond to a timbre and a pitch are stored in the waveform memory 9. The waveform data stored in the waveform memory 9 are selected by one set of waveform data, in consonance with an address sent from the tone generator 8, and sequentially read out. The waveform data, read from the waveform memory 9, are transmitted as tone waveform signals to a multiplier 11. A detailed explanation of the tone waveform data that are stored in the waveform memory 9 will be given later.

An envelope generator 10 employs envelope data sent from the CPU 1 via the system bus 14 and generates an envelope signal that is used to control the amplitude of a tone waveform signal. The envelope signal produced by the envelope generator 10 is also sent to the multiplier 11.

The multiplier multiplies the tone waveform signal, sent from the waveform memory 9, and the envelope signal, sent from the envelope generator 10, and produces a tone signal with an added envelope. Accordingly, a tone signal with added loudness or softness is generated for a musical tone. The digital tone signal with the added envelope is sent to a D/A converter 12.

The D/A converter 12 converts a digital tone signal from the multiplier 11 into an analog tone signal that is in turn transmitted to a sound system 13.

The sound system 13, including an amplifier 13*a* and a loudspeaker or headphones 13*b*, amplifies the analog signal that is received as an electric signal from the D/A converter 12, converts the resultant signal into an acoustic signal and outputs it. Musical tones are thus released from the sound system 13.

Figure 3:
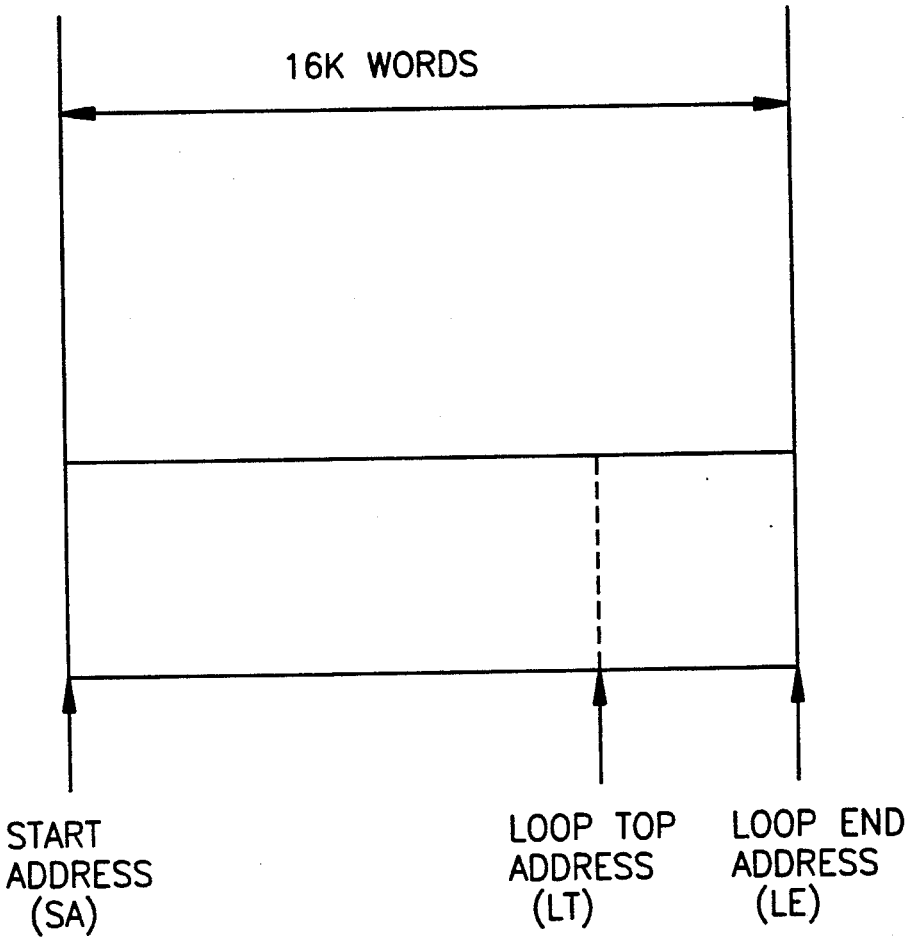
FIG. 3 is a graph showing a storage form of a waveform memory according to the present invention and to the prior art.

FIG. 3 is a diagram for explaining a storage configuration for one set of tone waveform data that is stored in the waveform memory 9.

One set of tone waveform data consists of, for example, 16K words, and its order of storage is a start address SA (hereafter sometimes referred to simply as "SA"), a rising portion of a musical tone, and a repetitive portion.

A loop top address LT (hereafter sometimes referred to as "LT") is a top address for repetitive reading, and a loop end address LE (hereafter sometimes referred to as simply "LE") is an end address for repetitive reading.

When one sustained musical tone is produced in accordance with key depression at the keyboard 4, the tone waveform data reading process starts at SA and is performed to LE, and subsequently returns to LT to continue data reading. Then, data reading is repeated in the interval between LT and LE to produce a sustained musical tone.

Figure 4:
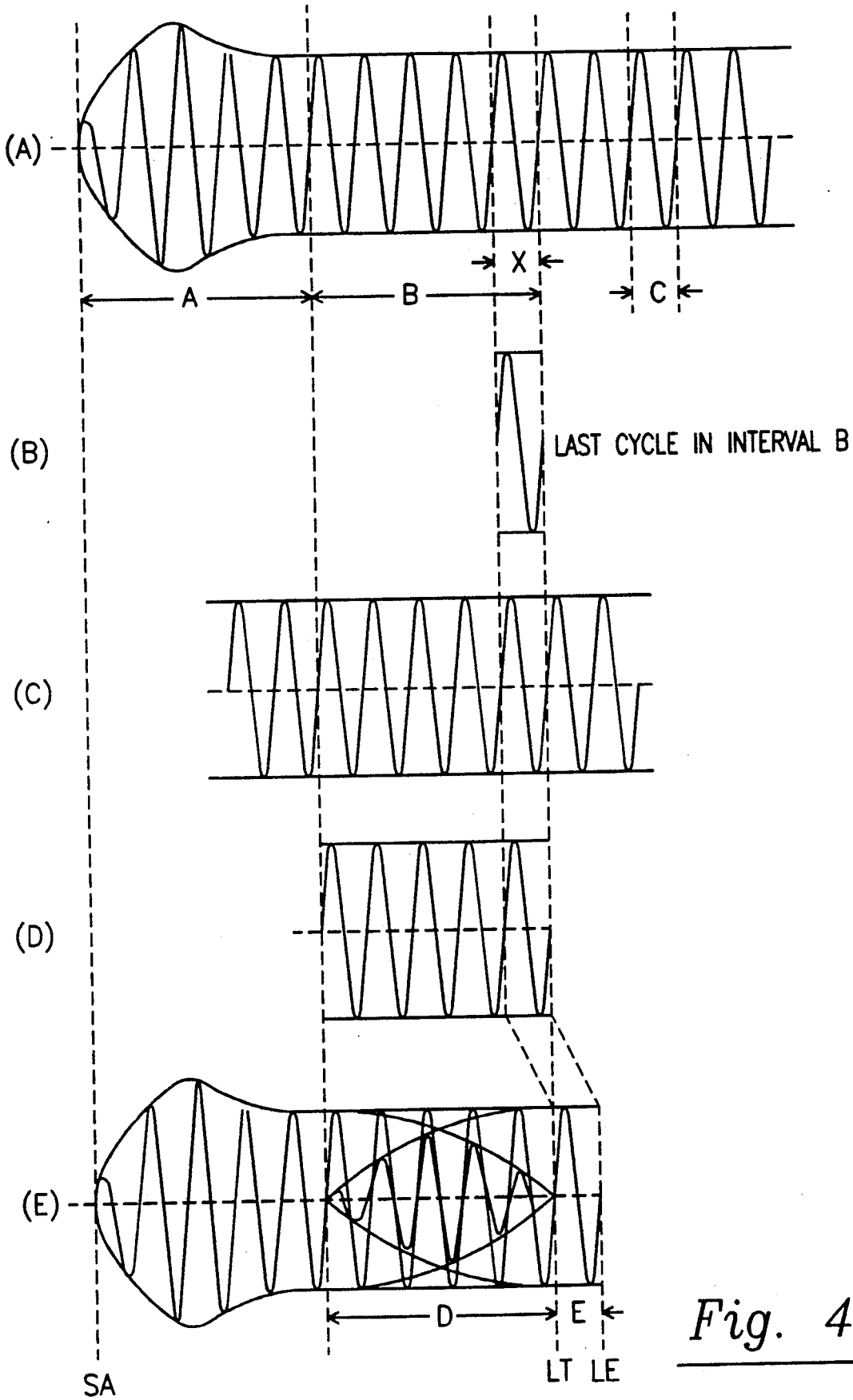
FIG. 4 is a diagram for explaining the production processing of tone waveform data that is stored in a waveform memory of the embodiment of the present invention.

FIG. 4 is a diagram for explaining a method for the preparation of tone waveform data, the feature of the present invention, that is to be stored in a waveform memory 9. The tone waveform data is stored in the configuration shown in FIG. 3.

An original tone waveform depicted in (A) in FIG. 4 is fetched as PCM data. Interval A for a rising portion of the original tone waveform and interval B for a following stationary portion are arbitrarily determined. A tone waveform of the last cycle (interval X) in interval B is extracted by well known extracting means as shown in (B). By replicating the loop of this waveform an arbitrary number of times with a suitable replicating means and by linking together the replicated loops with a suitable linking means, a waveform in (C) is obtained.

Figure 8:
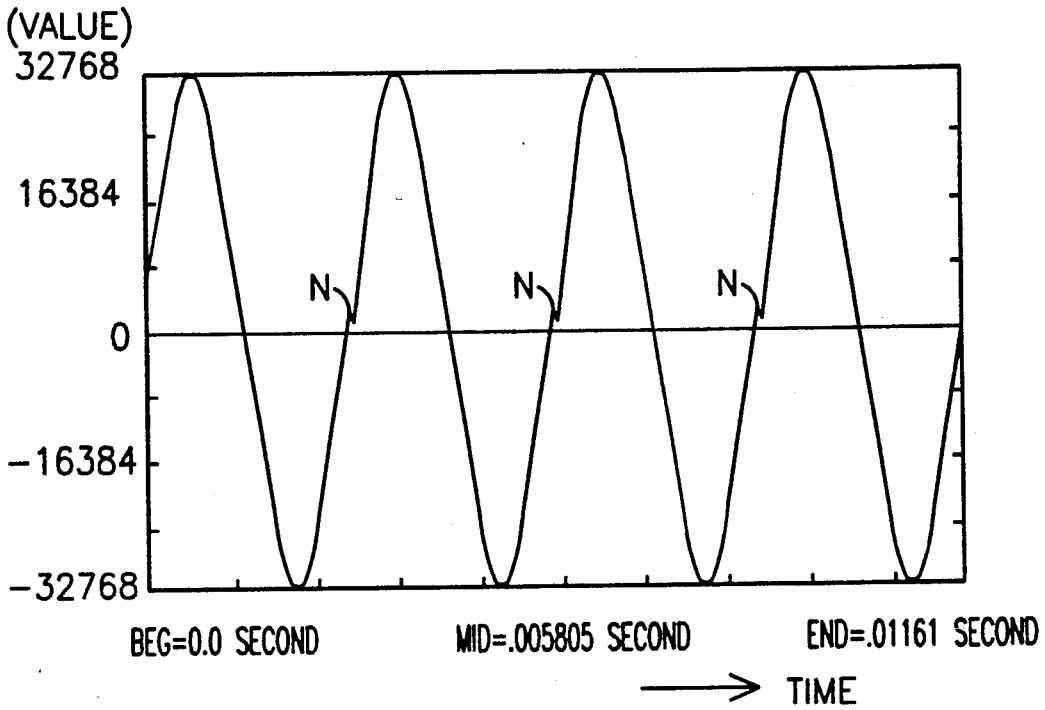
FIG. 8 is a graph depicting an example tone waveform obtained by a conventional system.
Figure 9:
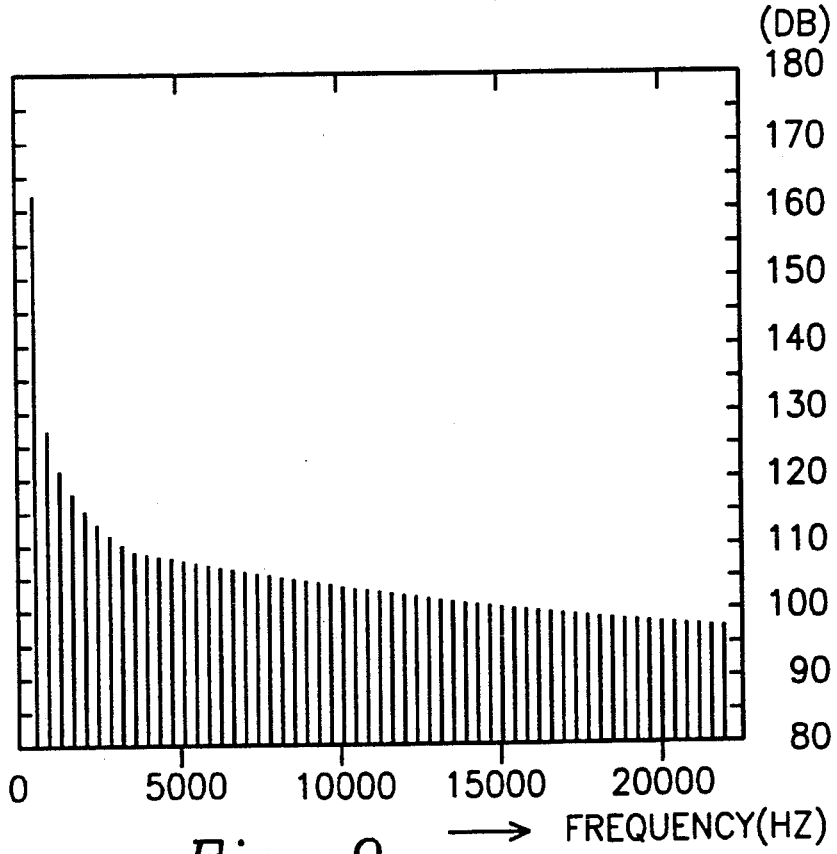
FIG. 9 is a spectrum graph showing a frequency response of the tone waveform in FIG. 8.

The tone waveform that is produced through the above processing is the same as the waveform example, shown in FIG. 8, that is obtained by a conventional system. As shown in the spectrum diagram in FIG. 9, this waveform would cause generation of multiple unwanted harmonic overtones, which are not originally included in the waveform.

Filter processing by a suitable filter means is thus performed on the waveform obtained by said replication while phase information is unchanged. In the filter processing, frequency components in a high frequency band are reduced by, for example, a low-pass filter. An FIR filter is employed for this processing to prevent phase information from changing.

Figure 5:
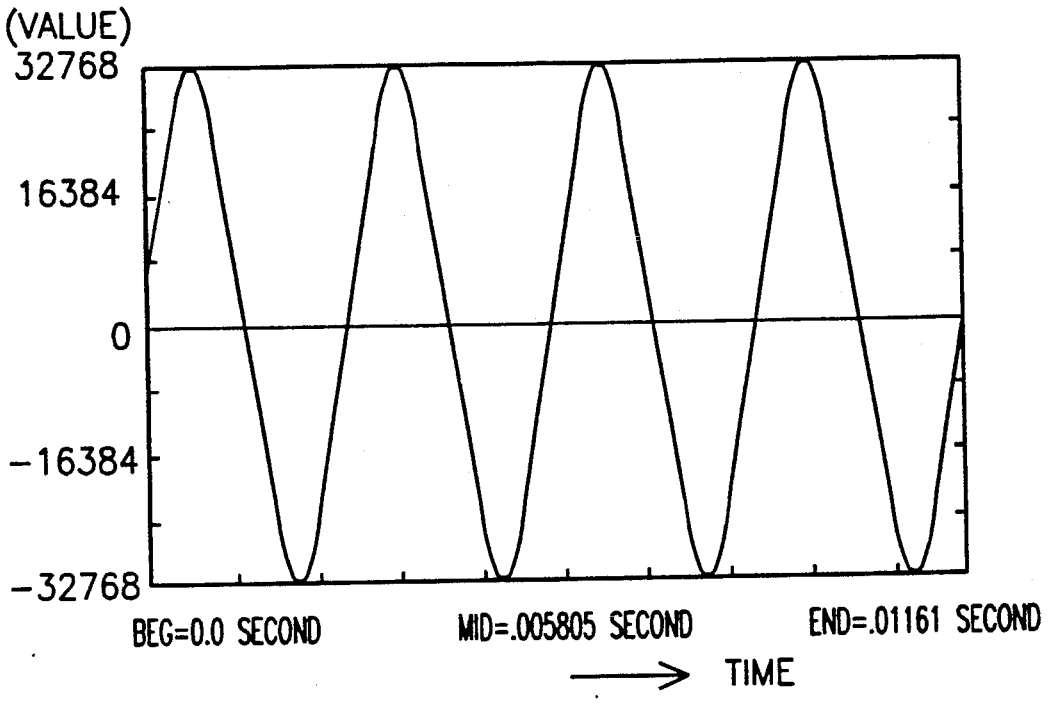
FIG. 5 is a graph showing an example of a waveform obtained by employing the embodiment of the present invention.
Figure 6:
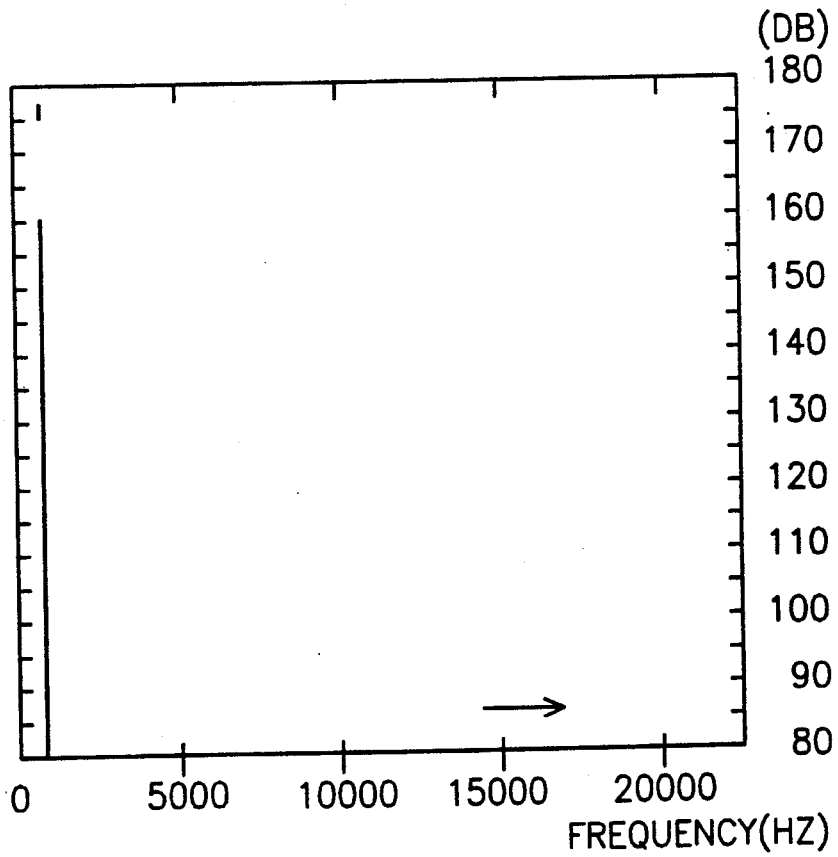
FIG. 6 is a graph of a spectrum showing a frequency response of the tone waveform shown in FIG. 5.

Interval X, equivalent to that of the loop of the waveform before repeating, is by a suitable extraction means from the filtered waveform, and by linking a number of the waveforms in interval X by a suitable linking means, a waveform in the same interval as interval B is prepared, as shown in (D). An example of a waveform obtained through this processing is depicted in FIG. 5. The frequency response of such a waveform as is depicted in FIG. 5 is shown in FIG. 6. The waveform in (D) in FIG. 4 corresponds to that in FIG. 5.

Then, as depicted in ( E ) in FIG. 4, waveform data for interval B is weighted with an attenuation characteristic, i.e., a fade-out characteristic by a suitable fade-out means, while waveform data for the interval in (D), which is equivalent to interval B, is weighted with a rising characteristic, i.e., a fade-in characteristic by a suitable fade-in means. Note that the basic pitch of a waveform of the original tone is equal to that in (D). The two sets of weighted waveform data are added together, i.e., cross-fade mixing is performed on these data by a suitable cross-fade mixing means.

Instead of interval D, interval C is arbitrarily determined following interval B, fast Fourier transform (FET) is performed on waveform data for interval C, and the linked waveform ( including phase information ), which is synthesized based on the resultant data, can be used.

In the waveform memory 9, a waveform for a rising portion of the original musical tone (interval A), a cross-fade mixed waveform (interval D), and one cycle of the waveform in (D) that has not been weighted and which is extracted by a suitable extracting means (interval E) are sequentially stored as tone waveform data for a single timbre.

Suppose that the head of interval A is start address SA, the head of interval E is loop top address LT, and its end is loop end address LE. These SA, LT and LE are stored in the ROM in conjunction with the tone waveform data.

When the tone waveform data stored in such a manner are read in order, tone generation starts at the rising portion of the waveform of the original musical tone, then smoothly shifts to the waveform of (D) by the cross-faced portion. Finally, waveform data for one cycle of (D), which has not been weighted, is repeatedly read to provide a smooth, sustained musical tone with no discontinuities.

Figure 2:
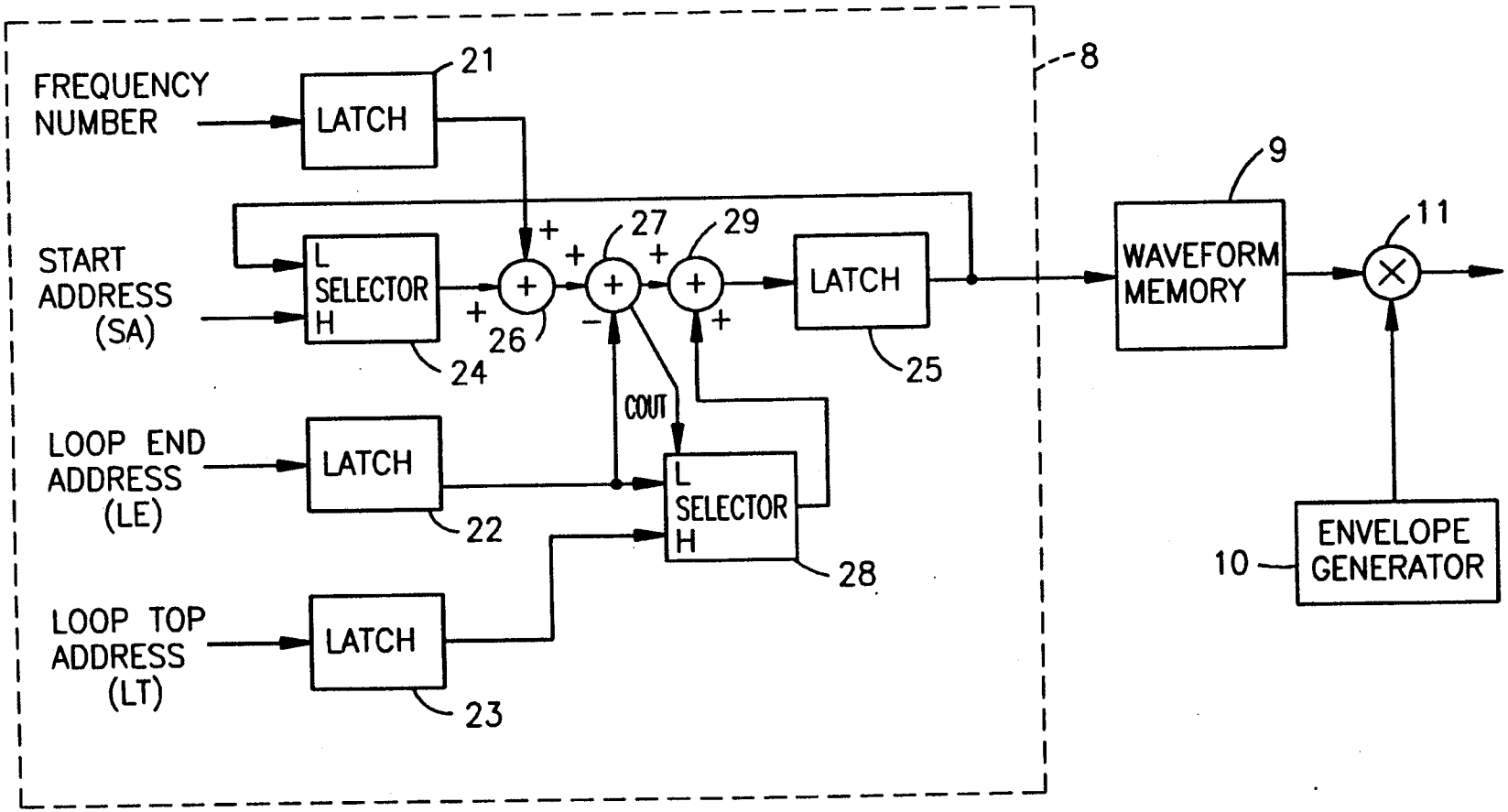
FIG. 2 is a block diagram illustrating the arrangement of a tone generator of the embodiment of a tone generating apparatus according to the present invention.

FIG. 2 shows one embodiment of the tone generator 8. A frequency number, start address SA, loop top address LT, and loop end address LE are sent from the CPU 1.

A latch 21 temporarily stores a frequency number that corresponds to a key code output from the keyboard 4. Likewise, latches 22 and 23 temporarily store LT and LE.

A selector 24 selects and outputs either SA or the output by a latch 25, which will be described later. When tone production starts, the selector 24 selects the H side using a control section (not shown) and outputs SA.

An adder 26 adds a frequency number stored in the latch 21 to the output of the selector 24 and produces a read address for the waveform memory 9.

An adder 27 subtracts loop end address LE, stored in the latch 22, from the result of the adder 26 to determine whether or not a read address has exceeded the loop end address LE.

A selector 28 responds to a carry-out signal COUT from the adder 27 and supplies to an adder 29 the loop end address LE, which is stored in the latch 22, or the loop top address LT, which is stored in the latch 23.

The adder 29 adds the output of the adder 27 to the output of the selector 28, and sends the result to the latch 25.

The latch 25 temporarily stores the output of the adder 29. The output of the latch 25 is then sent as a read address for tone waveform data to the waveform memory 9. The output of the latch 25 is also transmitted to the L side of the selector 24 and is used for calculation of the next read address.

The processing of the thus structured tone generator 8 will now be described.

The CPU 1 transmits a frequency number to the latch 21, the loop end address LE to the latch 22 and the loop top address LT to the latch 23. The selector 24 selects the H side using the control section (not shown).

When the start address SA is sent to the selector 24, during the first time slot the adder 26 adds the frequency number to the start address SA and calculates a read address for the waveform memory 9. Then, the adder 27 subtracts the loop end address LE, which is stored in the latch 22, from the read address output by the adder 26.

When the read address has not exceeded the loop end address LE, the carry-out signal COUT does not become active, and the selector 28 selects the L side and sends the loop end address LE to the adder 29. The adder 29 then adds the output by the adder 27 to the loop end address LE.

In other words, the value subtracted by the adder 27 is re-added during this process, and the adder 29 outputs the same result as the adder 26. This output is then set in the latch 25 and employed as a read address for the waveform memory 9.

During the next time slot, the selector 24 selects the L side. Through the same processing as described above, a frequency number is added to the current read address, and the next read address is calculated and sent to the waveform memory 9.

Read addresses are sequentially calculated in this manner, and when the read address has exceeded the loop end address LE, i.e., when the adder 27 outputs an active carry-out signal COUT, the selector 28 selects the H side.

The loop top address LT is then transmitted to one of the input terminals of the adder 29. The output of the adder 27 is sent to the other input terminal of the adder 29. By adding these values, an obtained value is used as a read address after compensating for a divergence from the loop top address LT or the loop end address LE.

Production of musical tones that correspond to key codes are continued by iteratively performing the above processing.

Figure 7:
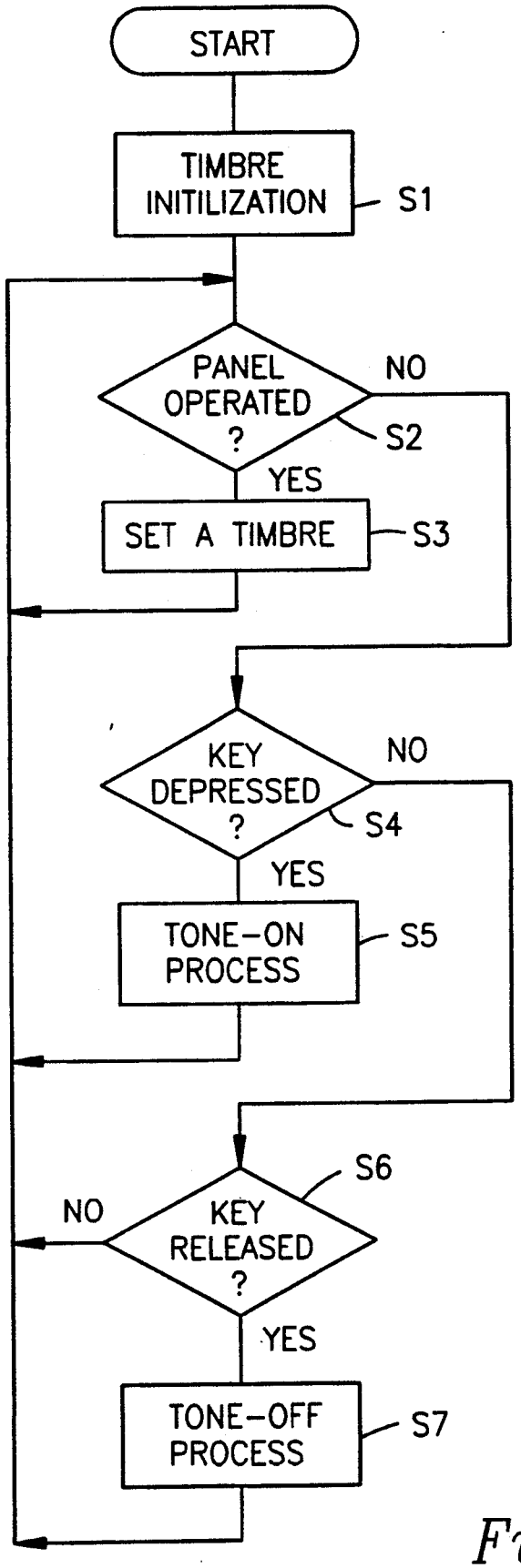
FIG. 7 is a flowchart for explaining the processing of the embodiment of an electronic musical instrument where a tone generating apparatus of the present invention applies.

The processing for the electronic musical instrument shown in FIG. 1 will now be described while referring to the flowchart in FIG. 7.

When the electronic musical instrument is activated at power-on, timbre initialization is performed (step S1). More specifically, a timbre pointer that is used to designate a timbre to be released is set to its initial value, and initial timbre data that are stored in a timbre table in the ROM 2, and that are designated by the timbre pointer, are sent to the tone generator 8.

Then, upon receipt of switch data from the panel 7 via the input/output interface 6, a check is performed to determine whether or not switches on the panel 7 have been manipulated (step S2).

When switches on the panel 7 are found to have been manipulated, the timbre pointer in the timbre table is set in consonance with the switch manipulation (step $3). The timbre data designated by the timbre pointer are then transmitted to the tone generator 8 and further transmit ted, as an upper address (not shown), from the tone generator 8 to the waveform memory 9 for the selection of waveform data, for a musical tone with a corresponding timbre, stored in the waveform memory 9.

If, at step S2, it is found that no switches on the panel 7 have been manipulated, data from the keyboard 4 are read, via the input/output interface 6, to determine whether or not a key has been depressed (step S4). When a key is found to have been depressed, tone-ON processing is performed ( step S5).

During the tone-ON processing, data for timbre, touch, and range of voice are transmitted to the tone generator 8 and the envelope generator 10 to start tone production. The release of musical tones from the sound system 13 is thereby initiated.

If, at step S4, it is found that no key has been depressed, data from the keyboard 4 is read, via the input-/output interface 6, to determine whether or not a key has been released (step S6). When a key is found to have been released, tone-OFF processing is performed (step S7).

During the tone-OFF processing, data for timbre, touch, and range of voice are transmitted to the tone generator 8 and the envelope generator 10 to halt tone production. Production of musical tones through the sound system 13 is thereby halted. Musical tone release is, however, not completely halted, as reverberations in consonance with key release continue to be released.

After the sequential processing that is described above has been terminated, execution control returns to step S2 and the aforementioned processing is repeated. During the iterative processing, timbres are altered in consonance with switch manipulation at the panel 7 and key depression or release at the keyboard 4, and musical tones are released or the release of musical tones is halted.

As described above in detail, when, according to present invention, waveform data for a given cycle in a specific interval of a waveform end portion are read out discontinuities do not appear at the junctures of the repetitive portions. It is therefore possible to provide a tone generating apparatus that ensures a natural musical tone flow, that can prevent the occurrence of unwanted harmonic overtones, and that can produce musical tones of high quality.

What is claimed is:

1. A tone generating apparatus that produces tones having smoothly linked data, comprising:

means for performing a one-time sequential reading of a set of waveform data for a rising, transient, and repetitive portion of a musical tone;

means for performing an iterative reading of said repetitive portion;

a waveform memory means for storing said set of tone waveform data, including data for said rising, transient, and repetitive portions;

means for defining a predetermined interval that defines the beginning and end of said transient portion;

fade-out means for applying a weighted attenuation characteristic to tone waveform data in said predetermined interval;

first extracting means for extracting a predetermined cycle of tone waveform data from said transient portion;

replicating means for replicating said extracted predetermined cycle of tone waveform data;

linking means for linking together data produced by replicating said extracted predetermined cycle of tone waveform data;

filtering means for filtering said linked-together tone waveform data without altering the phase thereof;

second extracting means for extracting from said linked together and filtered tone waveform data as many of said linked together, filtered cycles of tone waveform data as required to form an interval as long as said predetermined interval;

fade-in means or applying a weighted rising characteristic to said interval of said linked together, filtered cycles of tone waveform data;

cross-fade mixing means for cross-fade mixing together said faded out and faded in tone waveform data;

third extracting means for extracting a predetermined cycle of waveform data from said linked, filtered cycles of tone waveform data before said weighted rising characteristic is applied to said tone waveform data extracted by said second extracting means; and linking means for linking said predetermined cycle of waveform data extracted by said third extracting means to said interval of cross fade-mixed tone waveform data.

2. A tone generating apparatus according to claim 6, wherein said set of waveform data consists of 16K words, and its order of storage is a start address SA, said rising portion of a musical tone and said repetitive portion.

3. A tone generating apparatus according to claim 1, wherein said filtering means that does not alter phase information employs a low-pass filter to reduce frequency components in a high frequency band.

4. A tone generating apparatus according to claim 1 wherein said filtering means is an FIR filter.

5. A tone generating apparatus according to claim 1, wherein waveform data for said repetitive portion is data that is located between a loop top address LT and a loop end address LE.

6. A tone generating apparatus according to claim 1, wherein said predetermined cycle of data extracted by said first extracting means is the last cycle of data in said predetermined interval.

7. A tone generating apparatus according to claim 1, wherein said predetermined cycle of data extracted by said third extracting means is the last cycle of said data extracted by said second extracting means.

* * * * *

UNITED STATES PATENT AND TRADEMARK OFFICE

CERTIFICATE OF CORRECTION

PATENT NO. : 5,324,882

DATED : June 28, 1994

INVENTOR(S) : Fumiaki Ohta; Yasushi Sato

It is certified that error appears in the above-indentified patent and that said Letters Patent is hereby corrected as shown below:

Col. 8, line 2, after "linked" insert --waveform--.

Col. 8, line 46, change "6" to --1--.

Signed and Sealed this

Twenty-third Day of January, 1996

*Attest:*

*Attesting Officer*

BRUCE LEHMAN

*Commissioner of Patents and Trademarks*